US009163816B2

(12) United States Patent
Baschnagel

(10) Patent No.: US 9,163,816 B2
(45) Date of Patent: Oct. 20, 2015

(54) ENERGY DIVERTING LIGHT SOCKET PLUG

(71) Applicant: Robert Baschnagel, Garden City, NY (US)

(72) Inventor: Robert Baschnagel, Garden City, NY (US)

( * ) Notice: Subject to any disclaimer, the term of this patent is extended or adjusted under 35 U.S.C. 154(b) by 66 days.

(21) Appl. No.: 14/060,866

(22) Filed: Oct. 23, 2013

(65) Prior Publication Data

US 2015/0109784 A1 Apr. 23, 2015

(51) Int. Cl.

| | |
|---|---|
| ***F21V 23/04*** | (2006.01) |
| ***H01R 33/945*** | (2006.01) |
| *F21V 23/06* | (2006.01) |
| *H01R 103/00* | (2006.01) |
| *H01H 23/00* | (2006.01) |
| *H01R 31/06* | (2006.01) |
| *H01R 33/94* | (2006.01) |
| *H01H 17/00* | (2006.01) |

(52) U.S. Cl.

CPC ..... *F21V 23/04* (2013.01); *H01R 33/9453* (2013.01); *H01H 17/00* (2013.01); *H01H 23/00* (2013.01); *H01R 31/065* (2013.01); *H01R 33/942* (2013.01); *H01R 2103/00* (2013.01)

(58) Field of Classification Search

CPC ..... H05B 37/00–37/04; H21V 23/04; H21V 23/06

USPC ..... 362/85, 183–184

See application file for complete search history.

(56) References Cited

U.S. PATENT DOCUMENTS

| | | | | |
|---|---|---|---|---|
| 1,605,800 | A * | 11/1926 | Vogt | 200/51.02 |
| 3,893,019 | A * | 7/1975 | King et al. | 323/327 |
| 2005/0104524 | A1* | 5/2005 | Bishop | 315/56 |
| 2006/0209530 | A1* | 9/2006 | Schaak | 362/86 |
| 2010/0330843 | A1* | 12/2010 | Gao et al. | 439/620.21 |
| 2014/0252962 | A1* | 9/2014 | Chen | 315/152 |

* cited by examiner

*Primary Examiner* — Anh Mai
*Assistant Examiner* — Nathaniel Lee

(57) ABSTRACT

The present invention relates to an apparatus that has the specific features of attaching to a light bulb base and creating a light bulb with the additional feature of being able to be dimmed and flexed for directional lighting at the socket of the light bulb itself. An additional feature of this attachment is to allow for the light bulb to be turned off or on at the point of where the light bulb is attached to its socket from which electricity is drawn. A third feature of said device is to have the addition of a USB port also on the socket dimming device as a way to draw energy from the light bulb socket for the additional feature of using a USB port with some type of electronic device that can be charged at the base of the light socket itself.

4 Claims, 9 Drawing Sheets

ENERGY DIVERTING LIGHT SOCKET PLUG

REFERENCE TO RELATED APPLICATIONS

This patent application claims the benefit of U.S. Provisional Application No. 61/875,012 filed on Sep. 7, 2013, the disclosure of which is incorporated herein by reference in its entirety.

BACKGROUND OF THE INVENTION

1. Field of the Invention

The present invention relates to a portable removably attachable light bulb attachment, and more particularly to a portable removably attachable light bulb socket that has the specific features of attaching to a light bulb base and being able to dim or turn on/off the light bulb attached thereon directly at the light bulb socket and charge electronic device attached thereon via USB port on the light bulb socket. This is achieved since the device acts as an energy plug wherein said plug can draw energy from the existing socket and either reduce said energy for dimming purposes or redirect electrical energy to support an additional feature of the energy plug itself.

Said energy plug as described herein is for dimming a light bulb directly at the source of attachment to an existing light bulb socket. In addition to this dimming feature said device can be with varying embodiments. Said device can be flexible and thereby allow for the attached light bulb to flex when attached therein and allow for directional lighting. Said device could have a USB port attached to its body or any other electrical related device such as a mini camera for capturing motion within the room. A further embodiment could also be structured to have a bluetooth speaker device that could be used to project sound within a home room environment.

2. Description of Related Art

Electrical devices for incandescent light bulbs have been available for over 100 years. A lighting device including multiple groups of light-emitting elements provides convenience of usage for a user. The additional feature of dimming a light source saves energy when operating a light source and also allows a user to adjust the intensity of the light source to a desired level.

Electrical sockets can come in different sizes and shapes and are used in many different locations such as homes, offices or public places. Electrical sockets can be mounted on a permanent surface or on a moveable structure. Electrical sockets can be made in a variety of shapes or sizes.

Typically, electrical sockets were intended to be used for lighting purposes, or dimming purposes or power charging purposes.

Yet throughout all the years of usage an electrical socket that can serve multiple purposes does not exist.

Electric lighting is well understood and has been used for years. Also the ability to dim a light, bulb is also well understood. Usually in order to dim a light bulb, it is achieved by adjusting a dimmer switch that is located at the point where the light is either turned on or off. If a light bulb is screwed into a socket, the user would then rely upon the wall switch to have the additional feature of being able to dim the light. If such a switch exists, then the user can dim or lessen the brightness of the light emitting bulb accordingly.

This feature adds the ability of the user to adjust the brightness of the lighting within a room in accordance with his/her individual needs when using the lighting element itself.

Such a function can be used for many reasons. Primarily for aesthetics a person will at some point find the desire to dim the lighting within a particular room within their home environment. This can be done during dinner time to create a certain mood or while watching television in order to enable better viewing of the television itself. Also, nowadays with computers, the lighting within a room may be too bright to enjoy the use of the computer and there is a need to dim such lighting.

Yet unless a traditional light switch is equipped with a dimming feature the end user is not able to dim the lighting without undertaking the major project of changing the lighting within the traditional electrical setup within the wall of the room where the housing of the on/off switch resides.

The charging feature is extremely desirable in today's electronic world where there is a need to be able to charge many devices at the same time and a user quickly runs out of traditional electrical outlets to use for charging many different items at the same time.

It is also desirable to have additional USB port on the portable device. This can allow for additional feature attachments to said device. Sound speakers, video monitoring devices, and other electrical devices could tap into the USB port for electrical charge and functionality as such.

However, it is also noted that further embodiments of said device could be structured as such that a video monitoring device is built directly into the body of said energy plug and thus is permanently attached to said device and not attached by means of a USB port. The key element being that said device can act as a conduit to redirect or reduce said energy emanating from the existing light bulb socket itself.

Therefore, it is desirable to have a portable light bulb socket that allows the user to adjust the brightness of the lighting within a room at the portable light bulb socket in accordance with his/her individual needs when using the lighting element itself without using the dimming feature of the traditional light switch setup within the light bulb socket wherein there is also the added feature allowing to charge electronic devices at the same time.

It is noted that such a socket device could have variations that incorporate other electrical devices instead of a USB port. For example a mini camera could be equipped within the body of one embodiment.

SUMMARY OF THE INVENTION

It is the object of the present invention to create a removable attachable device to the base of a traditional light bulb to provide a light bulb base dimmer switch assembly having an arrangement that is particularly as such to create control for both on and off of the said light bulb as well as function as a dimmer for the load attached therein.

It is the object of the present invention to create a removable/attachable device to the base of a traditional light bulb that has an additional feature of functioning as a USB port for allowing for the charging of an electronic device that uses a USB wire for charging of said device itself.

A portable pocket sized light bulb attachment with an opening on its top for attaching a light bulb therein and with a structure that comprises a dimming switch, a USB port, an on/off switch, and said portable pocket sized light bulb attachment allows for a light bulb to be removably attached to said structure at the opposite side of the base of said structure. The portable pocket sized light bulb attachment can be removably attached to a light bulb socket at its base. The portable pocket sized light bulb attachment of the present invention performs the function of being a dimmer switch for an attached light bulb, an USB port receiver, and an on/off switch for the attached light bulb.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

The present invention relates to an electrical device that has dimming, charging and on-off features housed within one unit.

Figure 1:
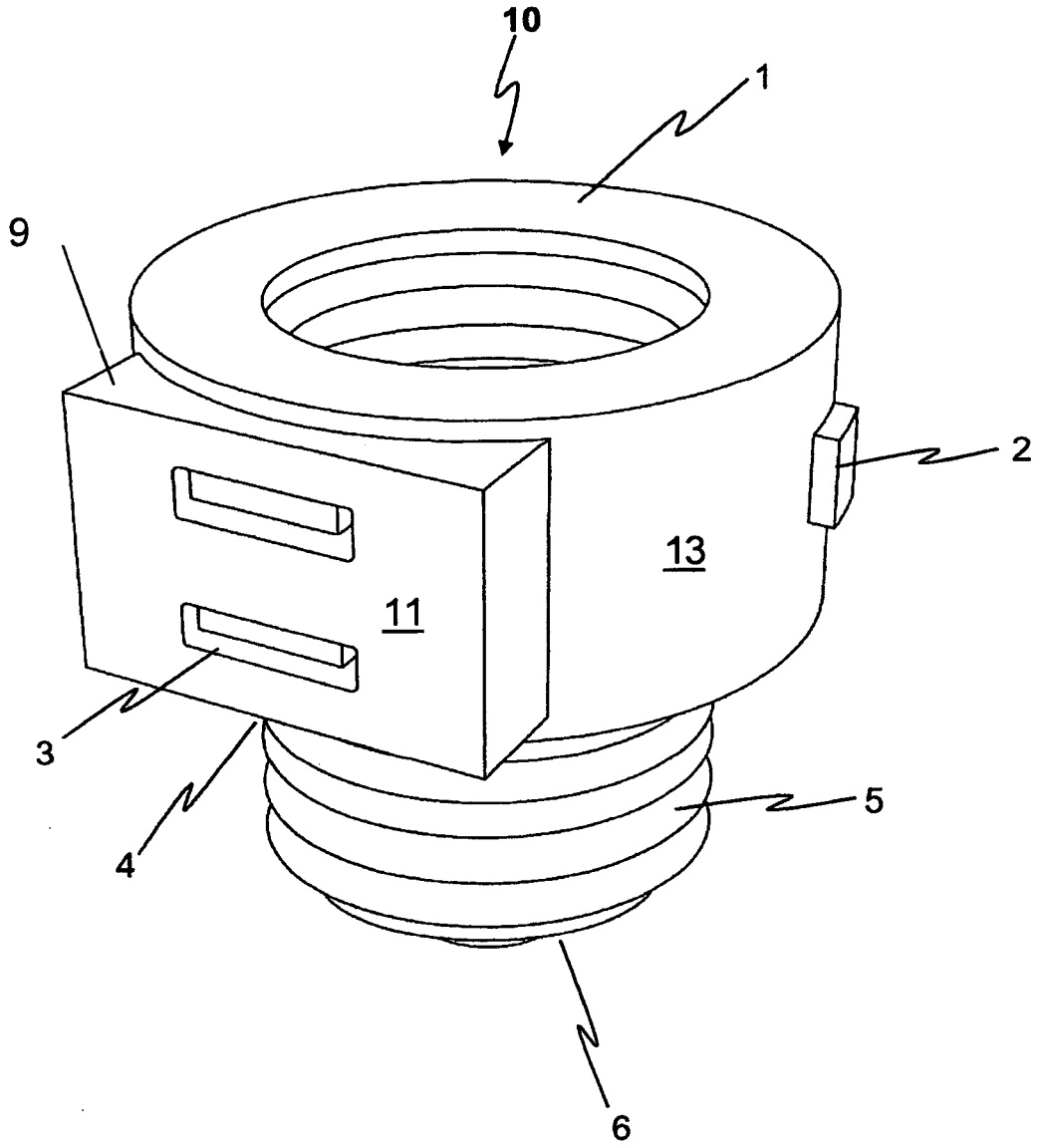
FIG. 1 is a perspective view of the "at the socket" dimmer device with two USB ports showing at the side of the device itself. The opening at the top of the device is an opening with female threads to allow for the receiving of a light bulb that has the exact fitting male threads at the base of said traditional light bulb.

Referring to FIG. 1, there is shown an embodiment of a portable pocket sized light bulb attachment 10 in accordance with principles of the present invention where the top opening 1 is threaded to allow for the receiving of a standard sized light bulb into the device itself. On the right side of the figure is seen a dimming switch 2. On the left side of the device are two USB ports 3 which serve to draw energy from the light bulb socket and provide for an additional feature of this device. Such ports 3 can be used for charging or supplying power to any electronic device that is able to use a USB port for such actions. The USB ports 3 are mounted in a housing 9 attached to an outside wall 13 of the structure. The housing 9 has a flat outer wall 11 into which the USB ports 3 are mounted. The portable pocket sized light bulb attachment 10 is designed to removably attached to a light bulb socket at its base 4 which has screw threaded contact 5 and electrical tip contact 6 to engage the light bulb socket.

The device 10 can be composed of plastic, metal, or any other material that is relatively electric use safe in a situation such as this where said device is being used to attach to a traditional wall or lamp light bulb socket.

The device 10 can have a dimension that is about 3 inches, more or less in length, 2 inches, more or less in width. The device 10 supports a clearance opening 1 at its upper end for the universal receiving of a traditional light bulb.

Light bulbs can come in a variety of watts but the base member of each light bulb is of a universal size and generally will be able to fit within the top opening 1 of this device.

Figure 2:
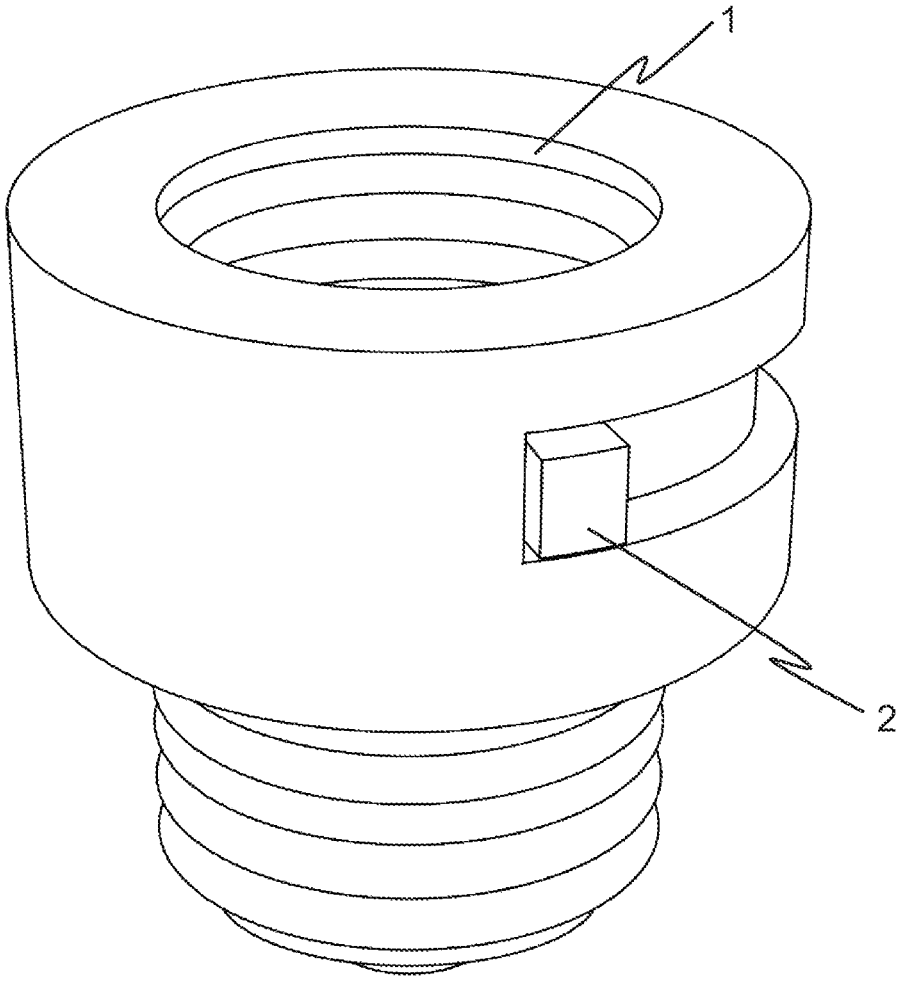
FIG. 2 is a plan view of a side of the "at the socket" device where the dimming switch is visible and in an "off" position and no light bulb is attached therein.

Referring to FIG. 2, there is disclosed a side view of said device 10 where this embodiment is with a dimming switch 2 but without a USB port 3. The dimming switch 2 can slide sideways and provide a dimming feature. Here the dimming switch 2 moves from an off to fully on position and along the way anywhere from zero electricity to 100% electricity is being supplied to the attached light bulb itself.

Figure 3:
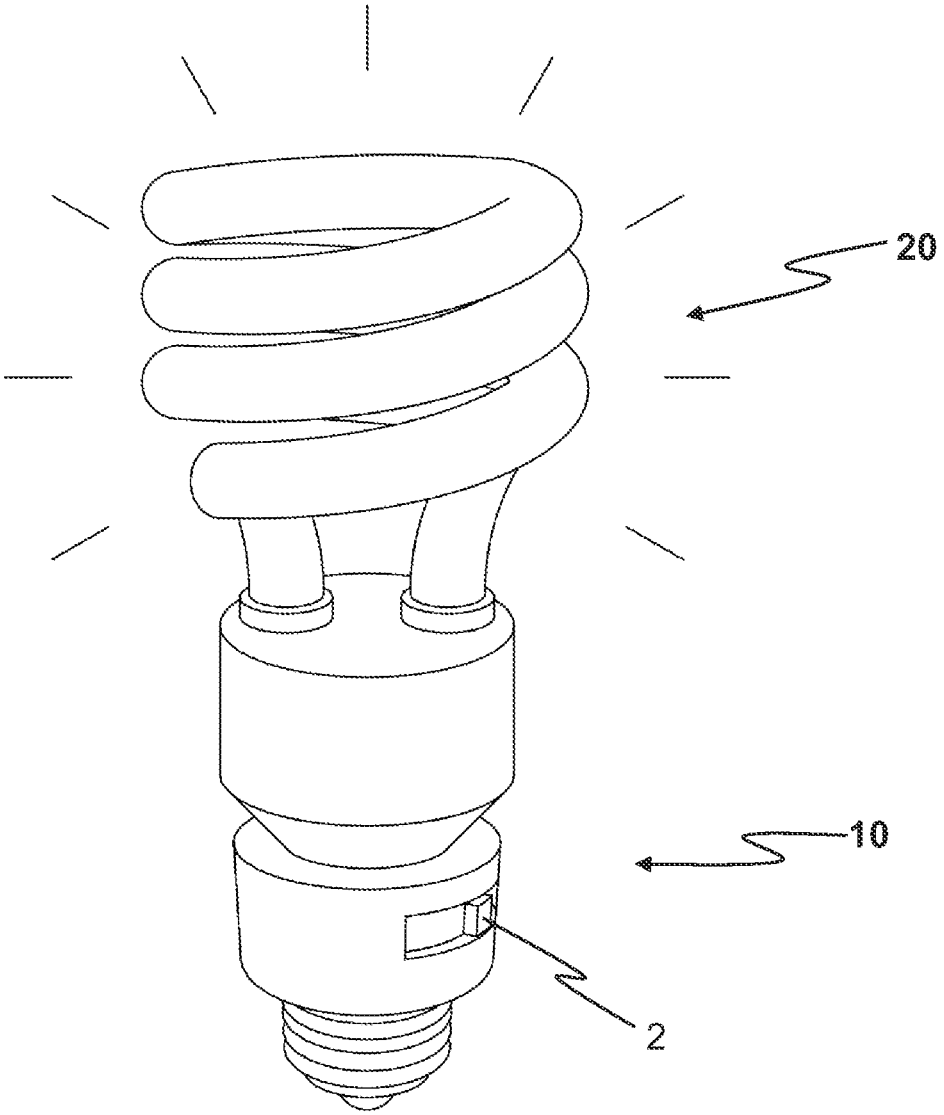
FIG. 3 is a plan view of a side of the "at the socket" device where the dimming switch is visible and in an "on" position and a light bulb is attached therein.

Referring to FIG. 3, there is shown an attached light bulb 20 to one embodiment of the device 10 itself. Here the dimmer switch 2 has been moved from the off position to an on position and light is therefore being seen emitted from the attached light bulb.

Figure 4:
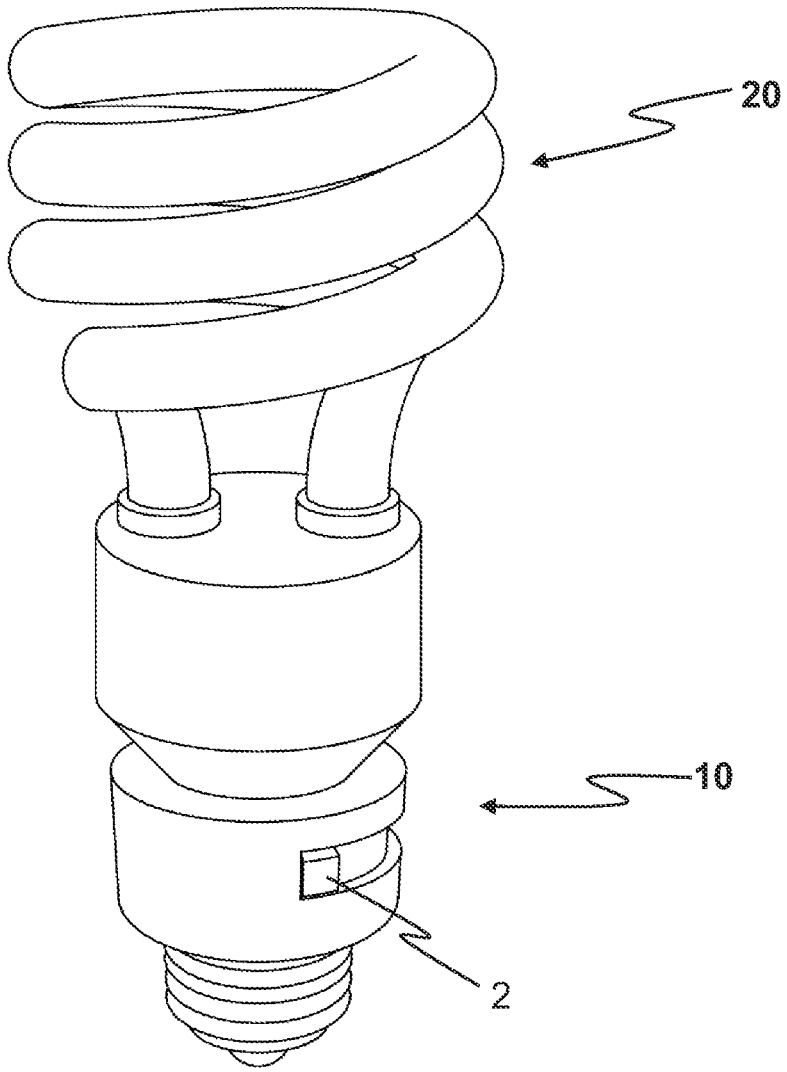
FIG. 4 is a side view of the "at the socket" device where the dimming switch is visible and in an "off" position. A light bulb is also attached to the device itself.

Referring to FIG. 4, there is shown the same embodiment 10 that is viewed in FIG. 3. Here however, the dimmer switch 2 has been moved to the off position an as a result no light is being seen from the attached light bulb 20 itself.

In both FIG. 3 and FIG. 4 it is with an understanding that the device 10 described in this patent application as well as the attached light bulb are attached to a traditional socket either in a wall or on a lamp. For ease of visibility such attachments are not shown in these two figures.

Figure 5:
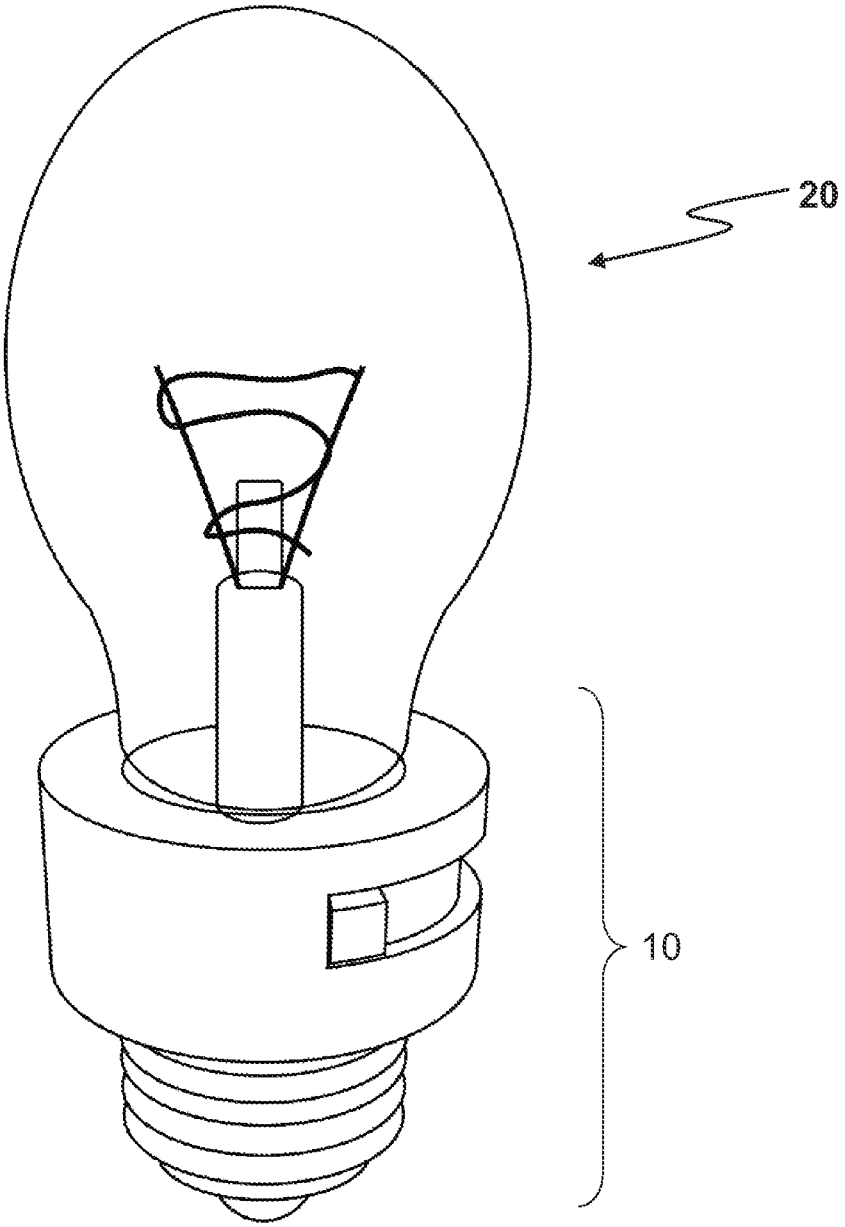
FIG. 5 is a side view of the "at the socket" device and shows how different shaped light bulbs are able to attach to the device itself.

In FIG. 5 there is seen another embodiment 10 of said invention where a different shaped light bulb 20 has been attached. Since most light bulbs have a universal size at the base of the bulb itself this device will serve as a receiver for a wide variety of different shaped bulbs themselves.

Figure 6:
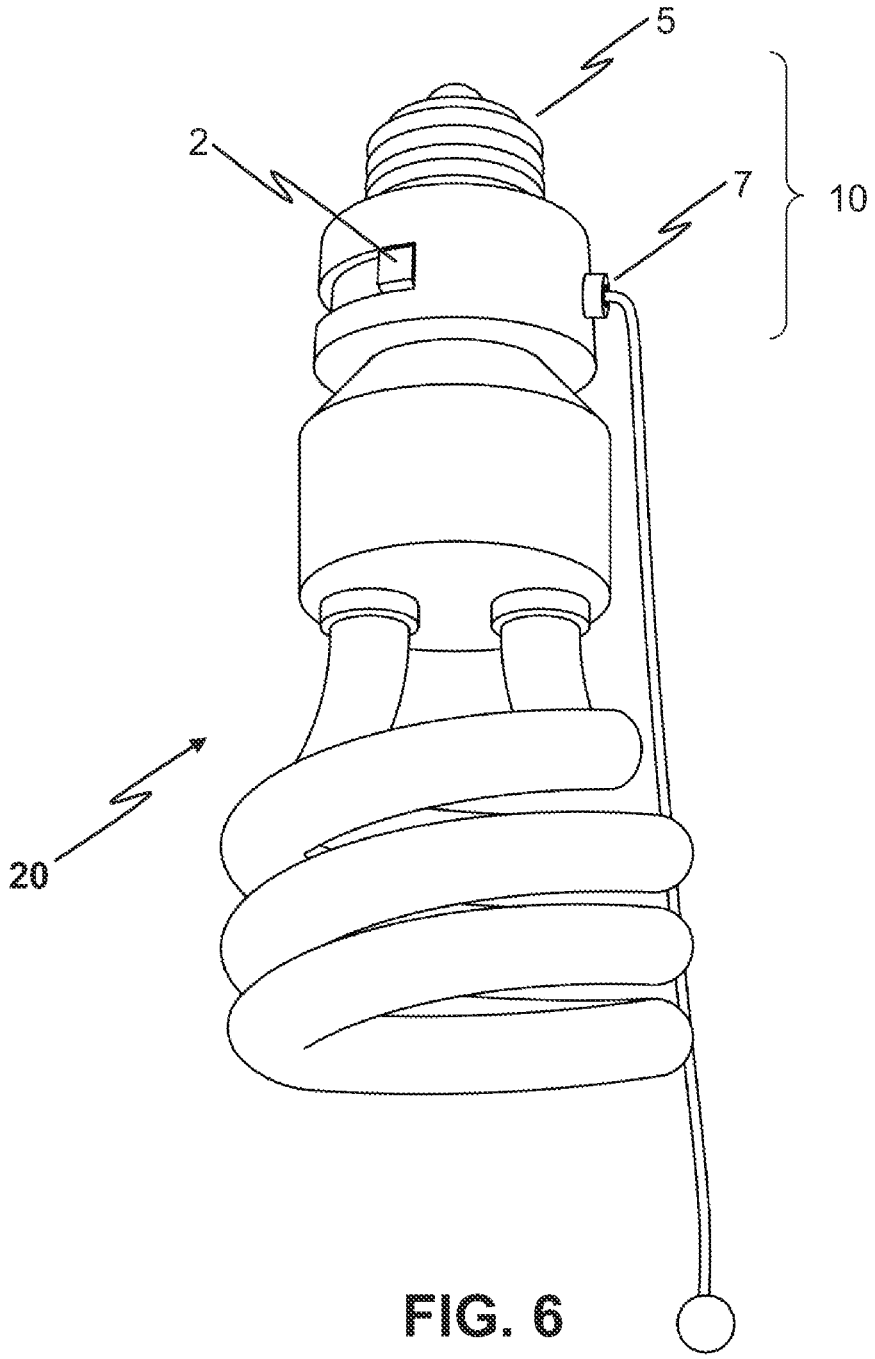
FIG. 6 is a side view showing an on off pull cord.

In FIG. 6 there is seen another embodiment wherein a stand alone on/off switch 7 has been added at the opposite side of the device where the dimmer switch 2 is located. This configuration serves as a way of allowing for a user to have control of the light bulb on/off feature at the base of the light bulb socket without affecting any other lights that may also be attached to the same electrical source from which this socket is attached.

For example within a room there are many sockets in the ceiling all of which are attached to one wall on/off switch. This invention allows for individual control of one of the lights and not all at the same time. Additionally, by having a stand-alone dimmer and on/off feature, the user can dim the light to a desired level and not have to keep resetting the desired dimmed level each time there is a desire to turn off or on the light itself.

Figure 7:
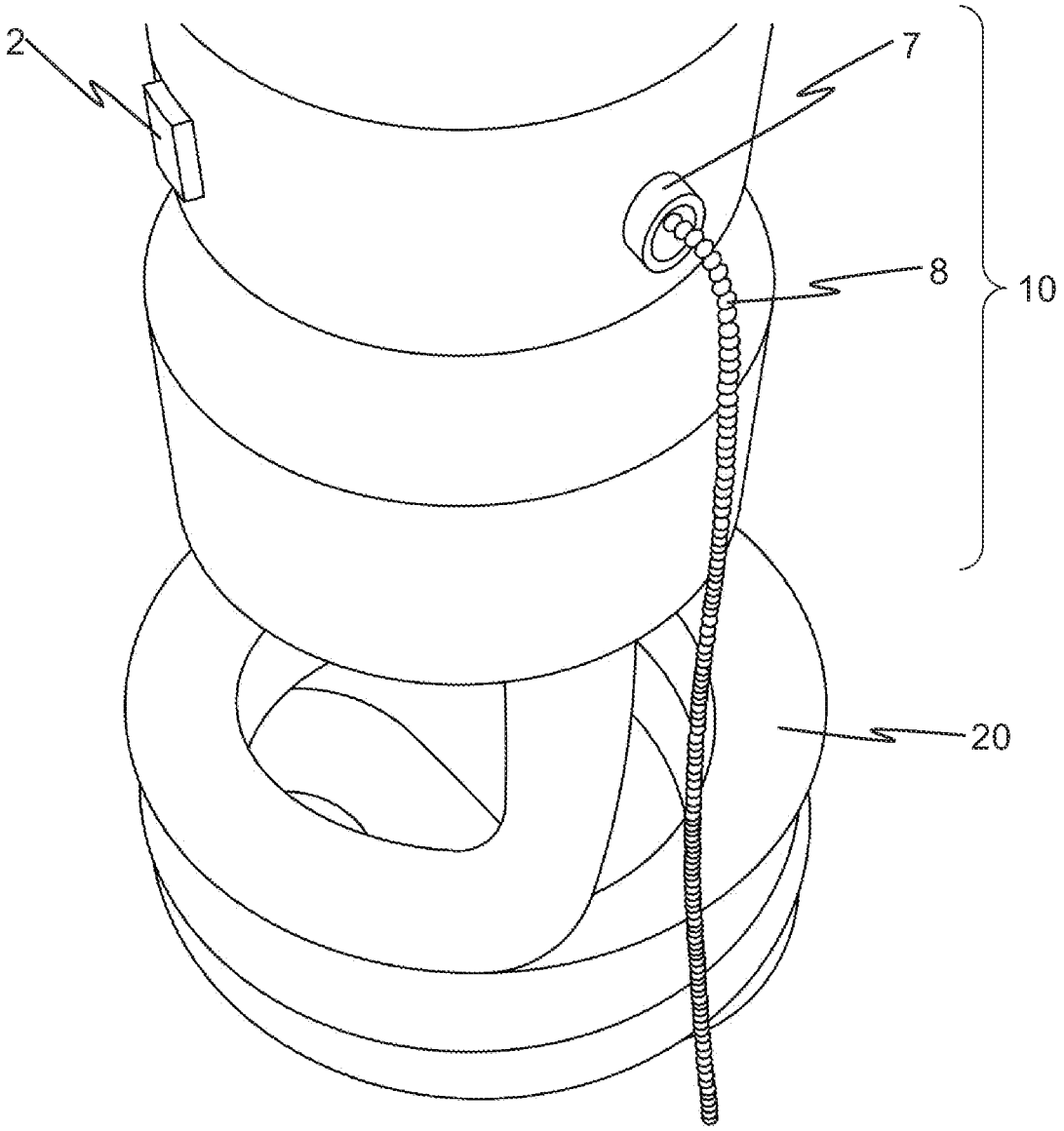
FIG. 7 is a close-up view showing the use of an on/off cord in the device itself.

FIG. 7 is a close-up view of an embodiment where there is a stand-alone on/off button 7 and a stand-alone dimmer switch 2. Herein the cord for turning on or off the light is made of a metal beaded chain like structure 8.

Figure 8:
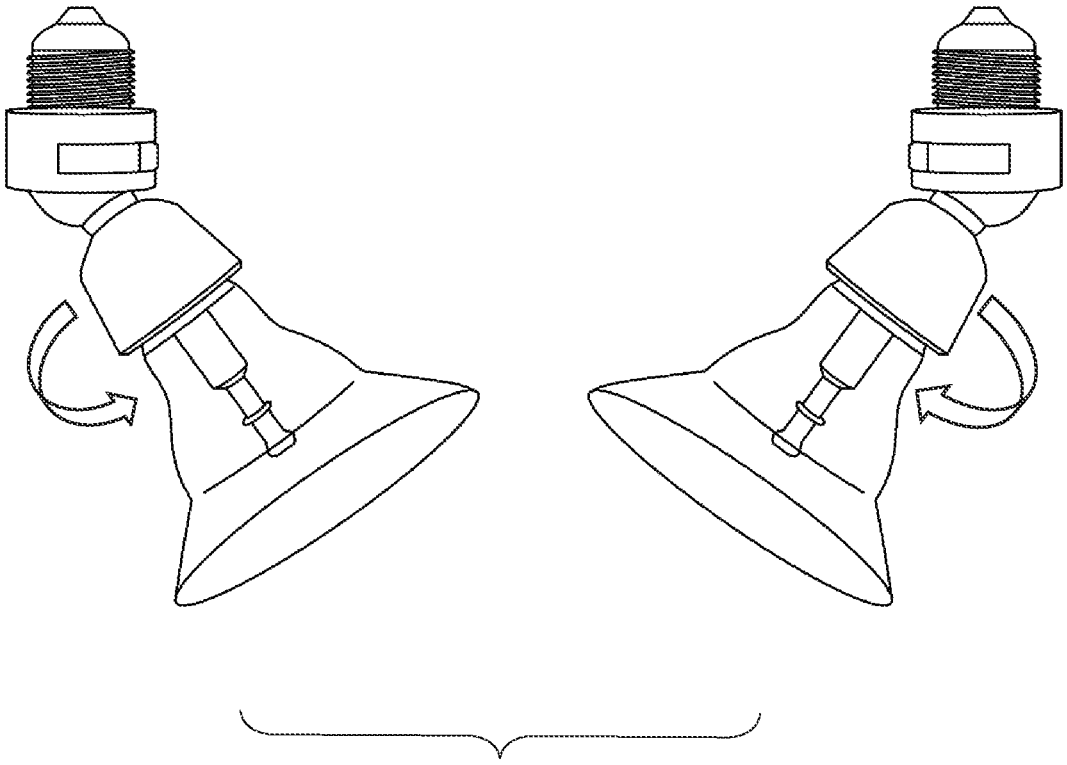
FIG. 8 is an embodiment where the attached light bulb is able to flex and allow for flexible lighting.

FIG. 8 is a variation embodiment wherein the energy diverting device has a flexing shaft for the attached light bulb thus changing the light stream from an otherwise stationary wall light bulb socket. This allows for flexible lighting to be achieved where the original socket does not allow for such flexible lighting.

Figure 9:
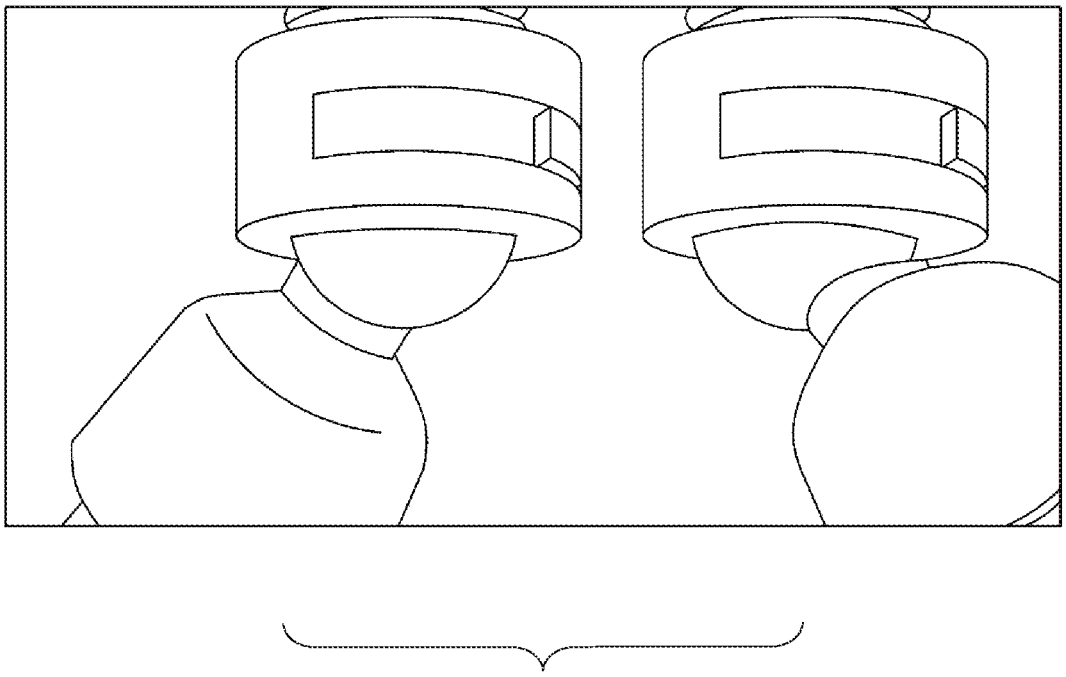
FIG. 9 is a close up embodiment where the attached light bulb is able to flex and allow for flexible lighting.

FIG. 9 shows a close up of said flexing shaft embodiment described in FIG. 8.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A portable pocket sized light bulb attachment comprising:

an opening on a top side for a light bulb to be removably attached to said attachment, wherein said opening on said top side has female threads to engage male threads on the light bulb;

a base on a bottom side of said attachment for removably attaching to a light bulb socket, wherein the base has male threads to engage female threads on the light bulb socket; and a structure between said top opening and said bottom base comprising:

a dimmer switch mounted in said structure;

at least one USB port for charging or supplying power to any electronic device that is able to use a USB port for drawing power, said at least one USB port mounted in a housing attached to said structure, said housing having a flat outer wall into which said at least one USB port is mounted;

wherein said structure performs the function of being a dimmer switch for an attached light bulb thereon and at a least one USB port.

2. The portable pocket sized light bulb attachment of claim 1, further comprising an on/off switch for turning on/off said attached light bulb.

3. A portable pocket sized light bulb attachment comprising:

an opening on a top side of said attachment for removably receiving a light bulb;

a base on a bottom side of said attachment for removably attaching to a light bulb socket; and a structure between said top opening and said bottom base comprising:

a dimming switch mounted in said structure; and at least one USB port for charging or supplying power to any electronic device that is able to use a USB port for drawing power, said at least one USB port mounted in a housing attached to said structure, said housing having an flat outer wall into which said at least one USB port is mounted; and an on/off switch;

wherein said structure performs the function of being a dimmer switch for an attached light bulb, a USB port receiver, and an on/off switch for said attached light bulb.

4. A portable pocket sized light bulb attachment with an opening on a top side for attaching a light bulb therein and with a structure that comprises:

a dimming switch;

at least one USB port on a housing having a flat outer wall attached to the structure;

an on/off switch;

a flexing shaft;

wherein said portable pocket sized light bulb structure is removably attached to a light bulb socket at its base;

and said portable pocket sized light bulb structure allows for a light bulb to be removably attached to said structure at the opposite side of the base of said structure;

wherein said structure performs the function of being a dimmer switch for an attached light bulb, a USB port receiver, a flexible shaft and an on/off switch for said attached light bulb.

* * * * *